US005682684A

United States Patent [19]

Wentzlaff et al.

[11] Patent Number: 5,682,684

[45] Date of Patent: Nov. 4, 1997

[54] METHOD FOR CONTROLLING DRYING PROCESSES IN HOUSEHOLD WASHER-DRYERS

[75] Inventors: Günter Wentzlaff, Berlin; Harald Moschütz, Grossbeeren; Ulrich Nehring, Berlin, all of Germany

[73] Assignee: Bosch-Siemens Hausgeraete GmbH, Munich, Germany

[21] Appl. No.: 581,874

[22] Filed: Jan. 2, 1996

[30] Foreign Application Priority Data

Dec. 30, 1994 [DE] Germany ..... 44 47 270.6

[51] Int. Cl.[6] ..... F26B 3/00

[52] U.S. Cl. ..... 34/495; 34/524

[58] Field of Search ..... 34/493, 495, 496, 34/497, 524, 537

[56] References Cited

U.S. PATENT DOCUMENTS

| | | | |
|---|---|---|---|
| 4,397,101 | 8/1983 | Rickard | 34/495 |
| 4,649,654 | 3/1987 | Hikino et al. | 34/493 |
| 4,738,034 | 4/1988 | Muramatsu et al. | 34/524 |
| 5,172,490 | 12/1992 | Tatsumi et al. | 34/495 |
| 5,555,641 | 9/1996 | Lee | 34/261 |

*Primary Examiner*—Henry A. Bennett
*Assistant Examiner*—D. Doster
*Attorney, Agent, or Firm*—Herbert L. Lerner; Laurence A. Greenberg

[57] ABSTRACT

Household washer-dryers include a laundry drum having an incoming air inlet and a waste air outlet, a blower in an air conduit, a heating device upstream of the air inlet, temperature and moisture sensors, a memory for measured values and process sequence variants and an electronic program control unit. A method for controlling drying processes in such devices includes measuring a waste air temperature at the air outlet at a starting point of a drying process. At least part of the heating device is periodically turned on and off during at least one time segment at a beginning of the drying process. Air temperature measurements are taken at an inlet of the heating device, upstream of the air inlet and immediately downstream of the air outlet, after an expiration of a starting phase having a duration being dimensioned in terms of a length of one to three heating periods, and differences from the measured values in the waste air, at the inlet to the heating device, and in the incoming air are formed and stored in memory. Process variables are measured at least periodically at frequencies of several times per second, and a plurality of memorized process sequences are called up to the memory each time for output to and processing in the program control unit, upon attainment of predetermined threshold values as a function of entered program parameters pertaining to type, amount and/or initial residual moisture of laundry.

18 Claims, 2 Drawing Sheets

P
1
1/2
0
1
2
3
4
t [min]

ϑ [°C]
100
50
20
A1
A2
S
ϑ3
ϑ31
ϑ4
ϑ42
ϑ41
ϑ21
ϑ2
t0
t1
t2
5
10
t60
t [min]

RF [%]
50
40
30
20
13
8
A3
A4
A5
A6
t0
t1
t2
5
10
t60
15
40
tRF30
45
tRF20
50
tRF13
55
tRF8
t [min]

METHOD FOR CONTROLLING DRYING PROCESSES IN HOUSEHOLD WASHER-DRYERS

BACKGROUND OF THE INVENTION

Field of the Invention

The invention relates to a method for controlling drying processes in household washer-dryers, including a laundry drum being rotatable about an at least horizontal axis and having an incoming air inlet and a waste air outlet, a blower in an air conduit, a heating device upstream of the incoming air inlet, temperature and moisture sensors, a memory for measured values and process sequence variants and an electronic program control unit.

One such method is known from German Published, Non-Prosecuted Patent Application DE 37 03 671 A1. The known method begins with a heating phase up to a set-point temperature (such as 60° C.), during which a positive temperature gradient $\Delta v/\Delta t$ is ascertained. In an ensuing intermediate cooling phase, a negative temperature gradient is ascertained. Since at the beginning of the drying process it is not possible to estimate the drying time accurately, a fictitious time for the predicted end of the drying process is given first. Indicating that time is done on the basis of experience obtained previously. The negative temperature gradient does allow calculating the predicted drying time which, although it still involves uncertainties, can already reduce the range of tolerance in a remaining-time display that replaces the fictitious time given. A parameter of "laundry type" that also affects the drying process must be imparted to the controller before the beginning of the drying process, through an input by the human operator. The aforementioned German Published, Non-Prosecuted Patent Application DE 37 03 671 A1 says nothing about the influence of the size of the laundry load involved in the drying process. The remainder of the drying process should then be controlled under the influence of the constantly measured residual moisture, in a known way. Ascertaining the particular time remaining should be done by calculating the negative residual moisture gradient, while taking into account the target residual moisture and the specified type of laundry. However, drying processes that go beyond a residual moisture measurement value of 8%, for example, corresponding to "slightly damp", must then be time-controlled. In order to do so, the remaining time is extrapolated from the previously calculated residual moisture gradient.

The known method has one overriding disadvantage, which is the necessity of waiting out the approximately ten to fifteen-minute heating phase before a halfway reliable value for the still-remaining time of the drying process can be calculated. Moreover, outside a relatively reliable measured value range between the limit values of about 30% to about 8%, the unreliable residual moisture measurement is a problem. The reliability of controlling the drying process solely from the measured residual moisture values is too low overall. One reason is the fact that the amount of laundry is a reliably measurable corrective parameter. Moreover, it is not possible to react to multiple supporting parameters, because during the early phase of a drying process, the known static control method is unable to take into account different ambient temperatures or different initial residual moisture contents or possible preheating of the machine from earlier drying processes. In the case of the length of time ranging from approximately 10 to 15 minutes, both the process control and the remaining-time display must therefore make recourse to mere guesses or unreliable empirical values. The measurements of the positive and negative temperature gradients that are made within that phase are also affected by such uncertainties and involve errors that make for an incorrect course of the process.

SUMMARY OF THE INVENTION

It is accordingly an object of the invention to provide a method for controlling drying processes in household washer-dryers, which overcomes the hereinafore-mentioned disadvantages of the heretofore-known methods of this general type, while using technical opportunities provided by modern electronic media to determine a requisite drying time of a load of laundry in a washer-dryer through the use of a technically simple, economical method, while such external factors as variable ambient temperatures or different initial residual moisture contents are unable to cause unreliable accuracy in the course of the method, the determination of the drying time or a display of a time remaining.

It is true that this object has already been attained by a method described in German Published, Non-Prosecuted Patent Application DE 44 42 250 A1. However, the expense for computer power required in that control method is considerable, and it can be replaced by memorized standardized process courses which empirically recur again and again, and into which an intervention can be made, depending on the particular physical status at the moment of the process to be controlled, while varying only a few parameter measurement values.

With the foregoing and other objects in view there is provided, in accordance with the invention, a method for controlling drying processes in household washer-dryers, including a laundry drum being rotatable about an at least horizontal axis and having an incoming air inlet and a waste air outlet, an air conduit leading to the incoming air inlet, a blower in the air conduit, a heating device upstream of the incoming air inlet, temperature and moisture sensors, a memory for measured values and process sequence variants and an electronic program control unit, which comprises measuring a waste air temperature at the waste air outlet at a starting point of a drying process; periodically turning at least part of the heating device on and off during at least one time segment at a beginning of the drying process; taking air temperature measurements at an inlet of the heating device, upstream of the incoming air inlet and immediately downstream of the waste air outlet, after an expiration of a starting phase having a duration being dimensioned in terms of a length of one to three given heating periods, and forming and storing in memory differences from the measured values in the waste air, at the inlet to the heating device, and in the incoming air; and measuring process variables, such as an actually elapsed time since a program start, and temperature values and moisture values of the laundry to be dried, continuously or at least periodically at frequencies of several times per second, and calling up a plurality of memorized process sequences to the memory each time for output to and processing in the program control unit, upon attainment of predetermined threshold values as a function of entered program parameters pertaining to at least one of type, amount and initial residual moisture of laundry.

Measuring the waste air temperature immediately at the starting time, records the present machine system temperature, which in the case of a waste air dryer as well also includes the ambient temperature of the machine, because of the ambient air being aspirated. Uncertainties about such supporting parameters are therefore eliminated.

In the initial time segment of the periodic turning on and off of the heating device or a portion of it, measured air temperatures at the three locations named provide information on the so-called thermal transfer function, which can be formed as a quotient of an input variable and an output variable. The thermal input variable is formed from the difference in temperatures at the inlet to the heating device and at the incoming air inlet to the drum. This variable is quite pronounced, both in a so-called waste heat dryer, which aspirates the air from the surroundings and vents the waste air back into its surroundings again, and in a condensation dryer, which has a closed process air conduit between the outlet of the drum and the inlet of the heating device but also has a condensation cooler. The thermal output variable represents the behavior of the heat consumer, namely the load of laundry, and is formed from the differences in the temperatures measured at the outlet of the drum and the inlet of the heating device and/or at the outlet of the drum and the inlet of the drum. This thermal transfer function, which is formed from the thermal inlet and outlet variables, automatically takes into account all of the ambient conditions, such as mains voltage fluctuations, type and amount of laundry, and initial residual moisture, having individual measured values which affect both the thermal input variable and the thermal output variable. By way of example, the thermal output variable rises faster as the heating output becomes higher, depending on the mains voltage, and as the amounts of laundry become smaller and the initial residual moisture becomes lower. With this thermal transfer function, it is possible to make an initial estimate of the program time to be expected, which can replace an empirical value for the drying time displayed during the first time segment of the drying process.

As the drying process proceeds, measured values for the temperatures or their differences, measured moisture values, and the particular actually elapsed time intervene again and again in the drying process, because on one hand they call up memorized process courses, and on the other hand these process courses vary, using actual measured values that differ from the empirically normally present parameter measurement values. These variations are also expressed in altered remaining-time displays that are to be corrected.

In accordance with another mode of the invention, as one process variable, the actually elapsed time from the program start until the first time an averaged measured value of the waste air temperature during the quasi-steady-state phase is reached, during which phase the heat input by the heating device keeps approximately in equilibrium with the heat removal by evaporation of the moisture from the laundry, is recorded and stored in memory. The aforementioned instant is the most suitable in making a decision as to which of the memorized process courses should be considered for the further handling of the load of laundry. At that time, the relevant decision data are in fact available, that is the parameters as to the amount of laundry and the initial residual moisture, by way of the system temperature and the ambient temperature, the actually imported heating output, and the calculated remaining time, which as a result of initial measurement inaccuracies differs from the actually elapsed time. At this instant, a first correction option is to observe the rise in the waste air temperature until the quasi-steady-state phase.

In accordance with a further mode of the invention, as one process variable, the actually elapsed time since the program start until the first time an averaged measured value for a predetermined residual moisture of the laundry, which is classified as reliably measurable for physical reasons for the first time in the course of the drying process, is reached, can be recorded and stored in memory. All of the residual moisture values that are above this averaged measurement value of about 30% can only be determined unreliably and therefore cannot be used for doubt-free control of the drying process. However, since until the actually elapsed period of time until the first time this residual moisture is reached is recorded, the temperatures at the aforementioned locations are monitored periodically again and again, the drying process can proceed uniformly and unchanged, as long as no disruptions that cause a temperature deviation occur. The attainment of the averaged measurement value of about 30% for the residual moisture of the laundry load allows checking of the remaining time values displayed until then, after a phase of exclusive subtraction of time segments since the quasi-steady-state phase was reached. The measurement instant upon reaching the residual moisture of 30% since the program start does in fact provide still other further information about the composition of the load of laundry in terms of the types of textiles. For example, moisture is more difficult to evaporate from a dense cotton fabric made up of thick yarns than from a thinner, lighter-weight cotton fabric. To a lesser extent, the quasi-steady-state phase is also longer when there is a high proportion of large items in the laundry load in comparison with smaller items of laundry. Smaller items, as they move about in the moving laundry drum, come apart from one another more easily and more often and are thus more fully exposed to the flow of hot air than large items of laundry. Depending on this, the measured value of about 30% for the residual moisture of the load of laundry is attained earlier or later. A new process course appended to the former process course is therefore not started until earlier or later.

The new process segment extends until the first time an averaged measured value (of 20%, for example) for a predetermined residual moisture of the laundry, which corresponds to a finding of a term "mangle-damp", is reached. Then, the actually elapsed time since the measured value for the residual moisture that is reliably measurable for the first time (RM=30%) is recorded and stored in memory. At this newly ascertained instant, a new process segment can in turn be induced.

In accordance with an added mode of the invention, the drying process is appropriately controlled by a further process variable, which defines the actually elapsed time from the attainment of the measured value for the first reliably measurable residual moisture until the first time an average measured value (13%, for example) is attained for a predetermined residual moisture of the laundry, which corresponds to a definition of a term "ironing-damp". This variable is recorded and stored in memory as well. As a result, the drying process can be corrected in a further process segment, if an incorrect evaluation of the previous process segments should have occurred.

In accordance with an additional mode of the invention, logically, the last process segment determinable by definitively detectable facts should also be variable through the use of a process variable, which is determined by the actually elapsed time since the attainment of the measured value for the first reliably measurable residual moisture until the first time an average measured value (8%, for example) is attained for a predetermined residual moisture of the laundry, which corresponds to a definition of a term "slightly dry". This measured value can also be recorded and stored in memory. It is also suitable for correcting the associated process segment in the same way as in the previous process segments.

In accordance with yet another mode of the invention, for the measured temperature and moisture values, mean values are formed from a limited number of periodically recurring individual measured values since a starting signal and are stored in memory. Empirically, the measured values for temperature and moisture vary within short periods of time, so that an individual measurement may under some circumstances give an incorrect picture of the physical status prevailing at that time. By way of example, temperature values can be detected 60 times per second. Four measurements, which may be stochastically distributed over a short period of time of a maximum of 4 seconds, produce a good basis for an at least approximately correct averaging of the measured values for the physical status prevailing at that time. The indicated period of time for the measurement segment should not be longer than 4 seconds, because otherwise process-dictated errors can occur. The minimum period of time for sixty measurements per second, for measurements that succeed one another directly, can therefore be approximately 67 ms. Advantageously, the aforementioned differences among the mean temperature measurement values are formed and stored in memory.

In accordance with yet a further mode of the invention, in order to increase the measurement accuracy, it is advantageous if in a memory device that is capable of storing only integral values for the measurement values, the measured values of the temperatures in the waste air and at the inlet to the heating device are doubled before the difference is formed. In the doubling, fractions in the measurement values can be doubled to the next-higher odd integer, so that inaccuracies in rounding down decimal fractions are reduced.

In accordance with yet an added mode of the invention, in order to call up memorized process courses, it is especially advantageous if upon a given attainment of measured values, different control signals are each supplied to a fuzzy processor, and the fuzzy processor, as a function of the contents of the particular control signal, calls up a predetermined process sequence and outputs a value for the duration of the drying process. In the case of the individual process segments, different standardized process courses can thus be stored in memory, which are optionally varied through the use of continuously measured parameters. When such a process course is called up, a value for the length of the drying process or for the remaining time at that time (the length of the drying process minus the actually elapsed time thus far since the start of the program) can simultaneously be output.

In accordance with yet an additional mode of the invention, the accuracy of the drying process can also be increased if the fuzzy processor, as a function of an automatically ascertained or entered value for the loading quantity, purposefully varies the threshold values of the temperature difference. Values to be entered for the loading amount are dependent on the skill at accurate estimation on the part of the human operator. It has already been noted above that in the startup phase of the drying process, observed temperature courses allow a conclusion to be drawn about the load amount, which can be more accurate than the estimate by the operator. It is therefore advantageous if a value ascertained in this way for the load amount has an influence on the threshold value of the particular temperature difference to be observed.

In accordance with again another mode of the invention, it is also advantageous if the fuzzy processor calculates a remaining time as a function of the called-up process course and of the value for the length of the drying process and input parameters for the type and/or amount of laundry and the target dryness, and outputs it to an output unit.

In accordance with again a further mode of the invention, in addition, the fuzzy processor, as a function of an automatically ascertained or entered value for the loading quantity, purposefully can vary the threshold values of the residual moisture, at which the time recordations are made. Since the drying performance of different-sized laundry loads proceeds differently, the starting condition for the particular process course, namely the attainment of the threshold value for the residual moisture, can be variously disposed while preserving the memorized process courses.

In accordance with again an added mode of the invention, in a display of the remaining time it is especially advantageous if the output remaining time is decrementally corrected by subtraction of the progression of time until it is recalculated on the basis of new control signals and measured values. Due to the relatively high inaccuracy in the length of the drying process that must still be waited out, it is sensible to define the decrements at 5 minutes up to an absolute remaining time of about 30 minutes, while toward the end (when the remaining time is about 30 minutes or less), the accuracy of calculation and the shortness of the still-remaining time justify decrements that are one minute in length. Alternatively, depending on the required correction, the individual decrements may be shorter or longer than the decrements being provided. At a calculated correction that requires a longer remaining time display than the actual display, it is advantageous, to avoid irritating the operator, to let the previous remaining time display stand until such time as the correction value is less than the remaining time currently displayed by at least the amount of the decrement being provided.

In accordance with again an additional mode of the invention, it is especially advantageous for manipulating the household washer-dryer if the fuzzy processor stores in memory empirical values for the composition of the particular drying process and its total length, from the drying processes that have elapsed earlier, as a function of input program parameters.

In accordance with still another mode of the invention, then it is in fact possible at the start of the program sequence, for an empirical value that is a function of the entered type and/or amount of laundry and of the target dryness level to be output for the entire program sequence duration. Since experience over a relatively long time, or in other words over a plurality of identical drying processes, can provide ever greater target accuracy for the duration of the particular drying process, the chance that an accurate program course duration can be displayed already at the beginning of the drying process is greater with increasing experience on the part of the fuzzy processor.

In accordance with still a further mode of the invention, it is therefore of particular advantage if the empirical value is compared with subsequently ascertained program sequence periods of time in programs proceeding with identical program parameters on the basis of calculations of the fuzzy processor and corrected, and the corrected empirical value is exchanged for the former empirical value in the memory.

In accordance with a concomitant mode of the invention, to that end, it is expedient if for correction of the empirical value, this value and a predetermined number of subsequently ascertained program sequence time periods are averaged.

Other features which are considered as characteristic for the invention are set forth in the appended claims.

Although the invention is illustrated and described herein as embodied in a method for controlling drying processes in household washer-dryers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
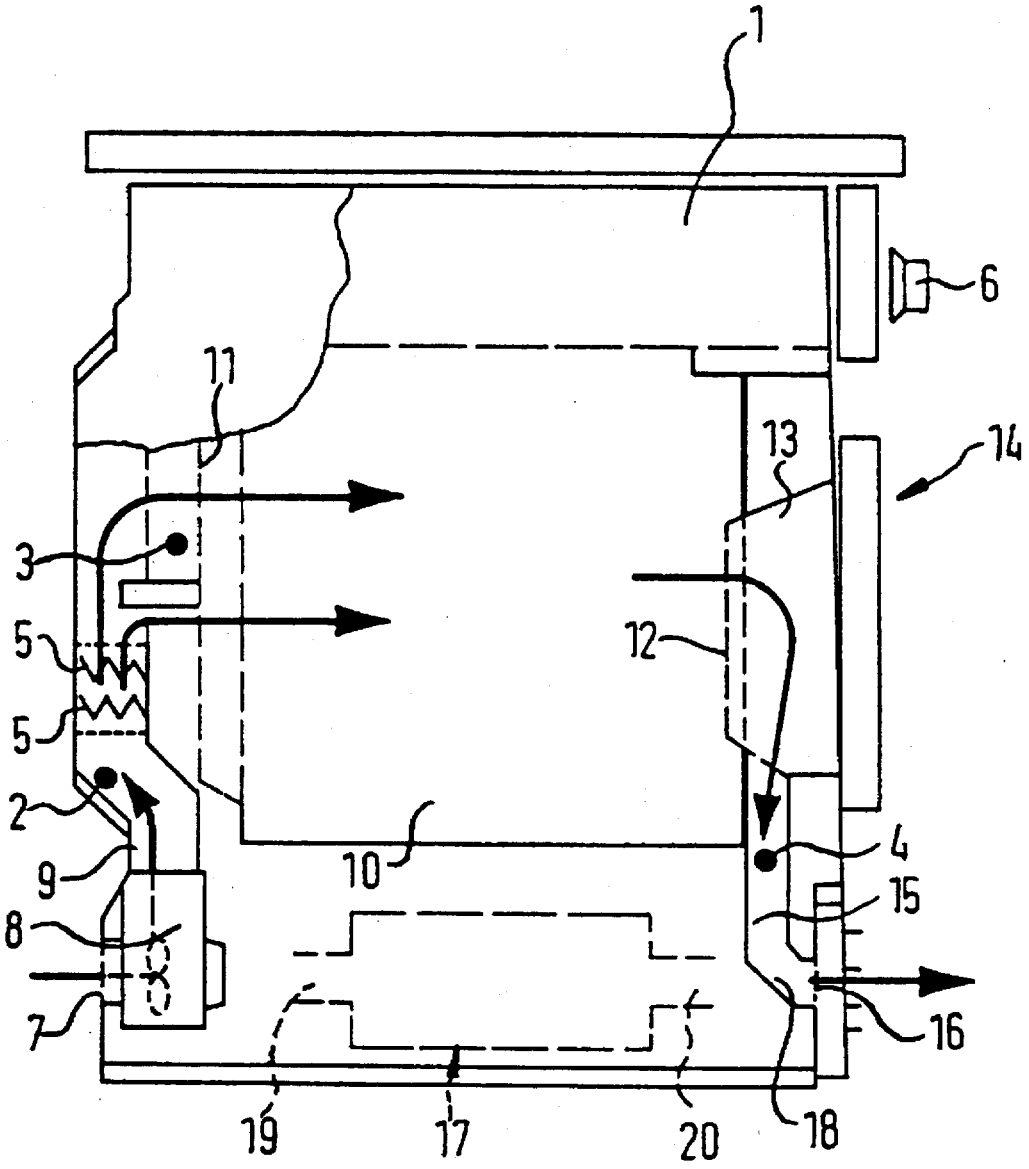
FIG. 1 is a diagrammatic, partly broken-away, side-elevational view of a washer-dryer equipped in accordance with the invention.

Referring now in detail to the figures of the drawing, it is noted that residual moisture values which are indicated for the illustrated exemplary embodiment refer to a basis of 0% relative moisture, at which an arbitrary fabric has an absolute water content at a temperature of 20° C. and at 65% relative humidity in ambient air.

A washer-dryer shown in FIG. 1 has a program control unit 1 in its upper part that is adjustable by a control knob 6 and includes a non-illustrated fuzzy processor controller. An incoming air opening 7 which is disposed on a lower rear side of the washer-dryer is connected through a blower 8, an incoming air conduit 9 and a heating device 5 to an inlet 11 of a laundry drum 10. An outlet 12 from the drum 10 communicates through a well 13 in a loading door 14 and through a waste air conduit 15 with a waste air outlet 16 on the front side of the washer-dryer. In order to provide possible closure of the dry-air circuit through a condenser 17, which is only shown in this case by in dashed lines, the blower 8 and an elbow 18 of the waste air conduit 15 must be rotated and connected to respective connecting necks 19 and 20 of the condenser 17.

As seen in flow direction, a fresh-air temperature transducer 2 is built into the incoming air conduit 9 upstream of the heating device 5, which is constructed in such a way as to be switchable to two heating stages. In the case where the machine is equipped as a waste air dryer, the fresh-air temperature transducer 2 measures the temperature of the aspirated ambient air. In the case where the washer-dryer is equipped as a condensation dryer, this temperature transducer measures the outgoing air optionally having residual heat, of the condenser 17. An incoming air temperature transducer 3 is disposed in the incoming air conduit between the heating device 5 and the inlet 11 to the drum 10. The incoming air temperature transducer 3 measures the temperature of the incoming air heated by the heating device 5. A temperature transducer 4 which measures the temperature of the waste air, is disposed in the waste air conduit 15 downstream of the outlet 12 of the laundry drum 10, as seen in the flow direction.

Figure 2:
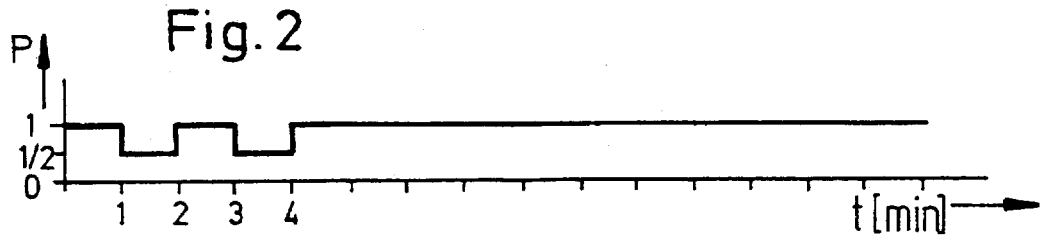
FIG. 2 is a diagram of power stages of a heating device over time.

The diagram shown in FIG. 2 illustrates the fact that the heating device 5 at the onset of the drying process is switched periodically back and forth to a full heating output and a half heating output. This is preferably carried out twice during each of the first four minutes. As is clearly visible in the diagram of FIG. 3, the result is an upswing and a downswing in a temperature $\nu_3$ measured at the temperature transducer 3 at the incoming air inlet 11 to the laundry drum 10. From a time $t_2$=4 minutes onward, heating is then carried out continuously with the full heating output, until the temperature transducer 3 ascertains an excessively high temperature, in order to switch back and forth between the full and the half heating output, although not shown in detail herein, depending on whether an allowable maximum temperature is reached or a minimum temperature fails to be attained.

At a starting time $t_0$ of the drying operation, a waste air temperature $\nu_{4s}$ is measured at the temperature transducer 4 in the waste air outlet. This temperature represents the outset state of the washer-dryer and also takes into account the temperature of the ambient air aspirated into the incoming air opening 7. Since at that moment the heating device 5 is still cold, the temperature being measured relates only to the situation of the surroundings and of a possibly applicable preheating of the washer-dryer from a previous drying process. At the starting time $t_0$, the heating device 5 is also switched to full heating output, and non-illustrated drives for the blower 8 and the laundry drum 10 are switched.

Figure 3:
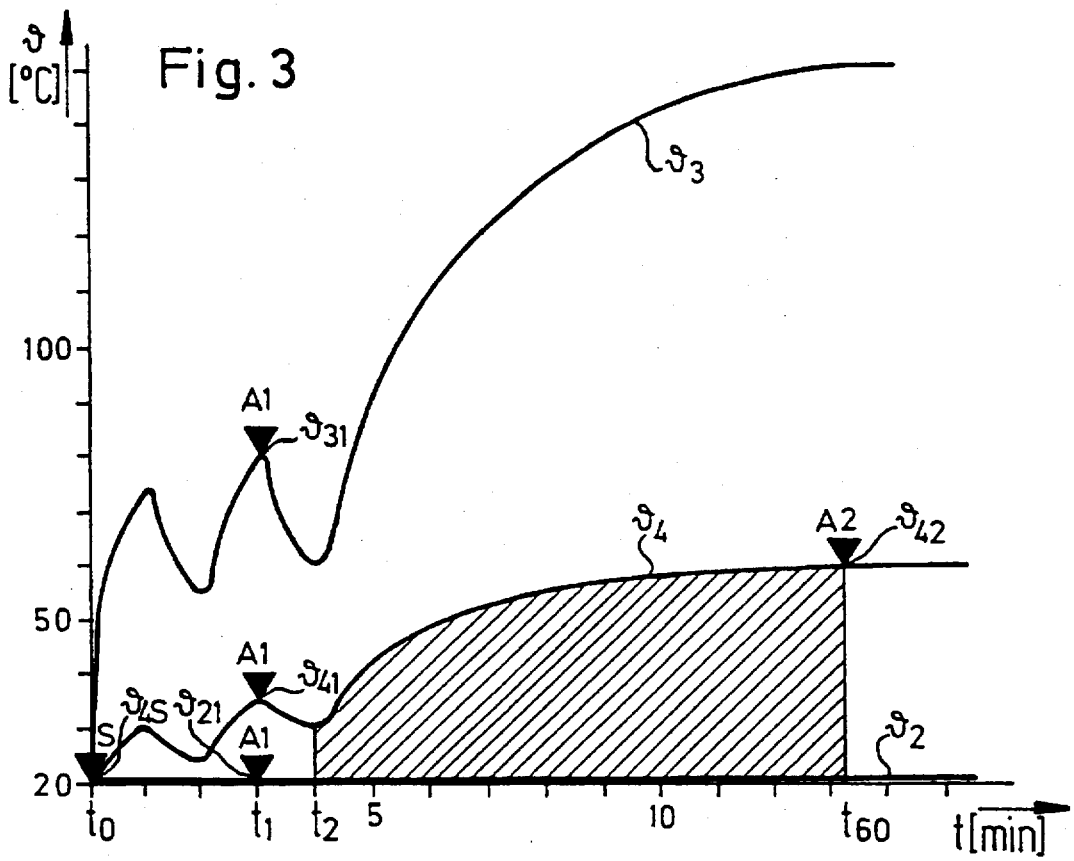
FIG. 3 is a diagram of temperatures at three measurement points shown in FIG. 1 over time.
Figure 4:
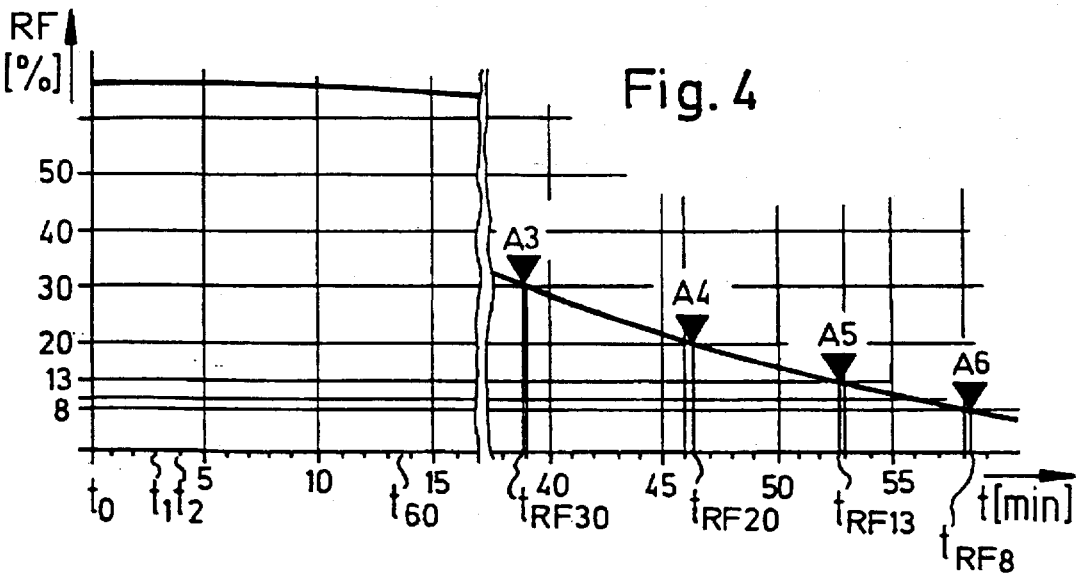
FIG. 4 is a diagram of a residual moisture performance of a load of laundry to be dried, which is plotted over time.

Upon starting from the cold state of the washer-dryer, the quantity of heat imported by the heating device 5 must initially also heat the parts of the washer-dryer that come into contact with the warm air stream, along with the load of laundry. In the example of FIG. 3, the temperature $\nu_3$ at the transducer 3 in the incoming air inlet 11 reaches approximately 75° after one minute, while a temperature $\nu_4$ at the transducer 4 in the waste air outlet 12 reaches only approximately 30°. In the next one-minute interval, the heating device 5 is switched back to half the heating output, and as a result the temperatures $\nu_3$ and $\nu_4$ drop again, with $\nu_3$ dropping to about 55° and $\nu_4$ to about 25°. In the second full ON period of the heating device 5 in the third one-minute interval, a temperature $\nu_{31}$ at the time $t_1$ reaches about 80°, while a temperature $\nu_{41}$ reaches about 35°. A temperature $\nu_{21}$ at the transducer 2 in front of the inlet of the heating device 5 still is assumed to amount to 20° C. at that time, which is the temperature of the aspirated ambient air. In the course of the drying process, the temperature of the ambient air naturally rises as well, since the washer-dryer gives up at least some of its output heat quantity into the room where it is located as well. This relates even to waste air dryers, in which the waste air at a temperature $\nu_4$ is carried out into the open through a waste air hose. Leakage losses and feedback effects mean that even then the ambient air is heated. However, the heating of the ambient air is considerably higher in a so-called condensation dryer, having a condenser 17 which is cooled by cooling air that draws heat from the condenser and transfers it to the room where the machine is located.

At the time $t_1$ at which the temperatures $\nu_{21}$, $\nu_{41}$ and $\nu_{31}$ are measured and averaged, differences $\nu_{4\text{-}2}=\nu_{41}-\nu_{21}$, $\nu_{3\text{-}4}=\nu_{31}-\nu_{41}$ and $\nu_{3\text{-}2}=\nu_{31}-\nu_{21}$, are also formed immediately. From the variables which are then present for the starting temperature $\nu_{4s}$, the temperature differences $\nu_{4\text{-}2}$, $\nu_{3\text{-}4}$ and $\nu_{3\text{-}2}$, and the elapsed time thus far for $t_1$=3 minutes, the fuzzy processor calculates a total drying time, which together with an algorithm 1 then called up by callup A1 for the process segment preceding is used for correction of the remaining time display that until then had been estimated. The remaining time to be displayed is calculated by the following equation.

$$t_{Rem}=t_{Fuzzytot}\times f_1-t_{Epr}+t_1 \quad (1)$$

In equation 1, the following symbols have the following meanings:

$t_{Rem}$: the remaining time to be displayed until the target dryness that is selected;

$t_{Fuzzytot}$: the total drying time calculated by the fuzzy processor on the basis of the variables available at the moment of the callup;

$f_1$: a target dryness-dependent correction factor in the form of a percentage for the various target dryness levels of "mangle-damp", "ironing-damp" for cotton, "ironing-damp" for wash and wear fabric, "slightly dry" for cotton, and "slightly dry" for wash and wear fabrics;

$t_{Epr}$: the current elapsed process time; and $t_1$: a constant for the target dryness levels of "very dry" and "extra dry".

This type of calculation is employed together with the algorithms in callups A1, A2 and A3.

In the case of the callup A2, a threshold value of 60° C. for instance, is made operative from the time $t_2$=4 minutes (of elapsed process time). That threshold must be attained by the temperature $v_4$ so that the fuzzy algorithm 2 will be called up. In the case of a correction of the remaining time to be displayed, the actually elapsed time $t_{60}$ since the program start is then recorded for the first time that the averaged measured value of the waste air temperature $v_{42}$=60° is reached, and this elapsed time is stored in memory and used for correction. At this waste air temperature $v_{42}$=60°, the so-called quasi-steady-state phase of the drying process begins. Within this phase, the heat input by the heating device remains approximately equal to the heat withdrawal from evaporation of the moisture from the laundry. At the end of the quasi-steady-state phase, the temperature $v_4$ of the waste air rises above 60°. In order to provide protection of the laundry, certain threshold values for the waste air temperature must not be exceeded in this case, and therefore if needed the heating device 5 is set back to half the heating output or entirely turned off.

In the course of the quasi-steady-state phase of the drying process, a non-illustrated device for direct measurement of the residual moisture that is present in the laundry is switched to be effective and it operates by the guide value measuring method. As soon as this guide value measuring device, which similarly to the temperature transducer is called up multiple times per second and its measurement value is correspondingly averaged, has reached the residual moisture value of RM=30%, the actually elapsed time until the first time that this mean value is reached is recorded and stored in memory and used in the callup A3 of the algorithm 3 in the fuzzy processor for correction of the remaining time display (equation 1).

In order to calculate the remaining times from callups A4–A6 on, the following equation 2 applies:

$$t_{Rem}=t_{Fuzzyrem}\times(1-f_2)+t_1+8\ min \quad (2)$$

In that equation, the symbols have the following meanings:

$t_{Rem}$: the remaining time until the target dryness which is selected;

$t_{Fuzzyrem}$: the remaining time calculated by the fuzzy processor using the available variables, until a residual moisture of 8% is reached;

$f_2$: a target dryness-dependent correction factor;

$t_1$: a constant for the target dryness levels of "very dry" and "extra dry".

Since the course over time of the decrease in residual moisture in the range between 30% and 8% can be assumed with adequate accuracy to be a straight line, the same equation 2 applies for the drying segments from the callup A4 onward.

Expediently, an option is provided in a memory region associated with the fuzzy processor for storing additional correction factors, which can act upon the input variables $v_{4s}$, $v_{21}$, $v_{31}$, $v_{41}$, $v_{42}$, $t_{60}$, $t_{RM30}$, $t_{RM20}$, $t_{RM13}$ and $t_{RM8}$, and on the output variables t Fuzzytot and $t_{Rem}$ as well as $t_{Fuzzyrem}$.

In the correction of the display, the procedure is as follows: In accordance with the various algorithm callups at the fuzzy processor, the still-remaining times are calculated as described, and the results are displayed. From that moment on until the next callup, the remaining time displays above 30 minutes are decremented in five-minute steps, while the display is made in integral values that are divisible by 5. Once a remaining time display of 30 minutes is reached the display is decremented in one-minute steps. If only two digits are available for displaying the remaining time, then for remaining times greater than 95 minutes, the number 99 is shown, and a blinking decimal point documents the fact that the time has been estimated and is above 99 minutes.

If when the particular remaining time is re-estimated, or when the transition to the time-controlled segment once the residual moisture of RM=0% is reached, a deviation from the instantaneously displayed remaining time occurs, then the display shifts to a new, lower display value, if the display is greater than the still-remaining time, or the displayed value remains until there is a match between the display and the prediction, if the display is less than the calculated remaining time. In the latter case, however, the right-hand decimal point then blinks, to indicate the current uncertainty.

In order to calculate the target dryness levels of "very dry" and "extra dry", a timing controller is connected, because of the assumed rectilinearity of the still-remaining drying course. During these time-controlled program segments, the display is decremented down to zero. At the end of the cooling-down phase, which is also included in the calculation of the remaining time, the remaining time display is switched off. It is readily apparent from this that the drying program has ended. The so-called wrinkle prevention phase, which is no longer part of the actual drying process, then ensues.

We claim:

1. A method for controlling drying processes in household washer-dryers, including a laundry drum being rotatable about an at least horizontal axis and having an incoming air inlet and a waste air outlet, an air conduit leading to the incoming air inlet, a blower in the air conduit, a heating device upstream of the incoming air inlet, temperature and moisture sensors, a memory for measured values and process sequence variants and an electronic program control unit, which comprises:

measuring a waste air temperature at the waste air outlet at a starting point of a drying process;

periodically turning at least part of the heating device on and off during at least one time segment at a beginning of the drying process;

taking air temperature measurements at an inlet of the heating device, upstream of the incoming air inlet and immediately downstream of the waste air outlet, after an expiration of a starting phase having a duration being dimensioned in terms of a length of one to three given heating periods, and forming and storing in memory differences from the measured values in the waste air, at the inlet to the heating device, and in the incoming air; and measuring process variables at least periodically at frequencies of several times per second, and calling up a plurality of memorized process sequences to the memory each time for output to and processing in the program control unit, upon attainment of predetermined threshold values as a function of entered program parameters pertaining to at least one of type, amount and initial residual moisture of laundry.

2. The method according to claim 1, which comprises measuring an actually elapsed time since a program start, and temperature values and moisture values of the laundry to be dried, as the process variables.

3. The method according to claim 1, which comprises measuring the process variables continuously.

4. The method according to claim 1, which comprises recording and storing in memory as one of the process variables, an actually elapsed time from the program start until a first time that an averaged measured value of the waste air temperature during a quasi-steady-state phase is reached, during which phase a heat input by the heating device keeps approximately in equilibrium with a heat removal by evaporation of the moisture from the laundry.

5. The method according to claim 1, which comprises recording and storing in memory as one of the process variables, an actually elapsed time from the program start until a first time that an averaged measured value for a predetermined residual moisture of the laundry being classified on physical grounds as being reliably measurable for the first time in the course of the drying process, is reached.

6. The method according to claim 1, which comprises recording and storing in memory as one of the process variables, an actually elapsed time since an attainment of a measured value for a first reliably measurable residual moisture until a first time that an average measured value for a predetermined residual moisture of the laundry that corresponds to a definition of a term mangle-damp.

7. The method according to claim 1, which comprises recording and storing in memory as one of the process variables, an actually elapsed time since an attainment of a measured value for a first reliably measurable residual moisture until a first time that an average measured value is attained for a predetermined residual moisture of the laundry, corresponding to a definition of a term ironing-damp.

8. The method according to claim 1, which comprises recording and storing in memory as one of the process variables, an actually elapsed time since an attainment of a measured value for a first reliably measurable residual moisture until a first time that an average measured value is attained for a predetermined residual moisture of the laundry, corresponding to a definition of a term slightly dry.

9. The method according to claim 1, which comprises forming and storing in memory mean values for measured temperature and moisture values from a limited number of periodically recurring individual measured values since a starting signal.

10. The method according to claim 9, which comprises forming and storing in memory a difference among the mean temperature measurement values.

11. The method according to claim 10, which comprises doubling the measured values of the temperatures in the waste air and at the inlet to the heating device, before the difference is formed.

12. The method according to claim 9, which comprises supplying each of different control signals to a fuzzy processor, and calling up a predetermined process sequence and outputting a value for a duration of the drying process with the fuzzy processor, as a function of contents of a particular control signal.

13. The method according to claim 12, which comprises purposefully varying threshold values of the temperature difference with the fuzzy processor, as a function of an automatically ascertained or entered value for a loading quantity.

14. The method according to claim 12, which comprises purposefully varying threshold values of the residual moisture at which time recordations are made, with the fuzzy processor, as a function of an automatically ascertained or entered value for a loading quantity.

15. The method according to claim 12, which comprises decrementally correcting an output remaining time by subtraction of a time progression until a recalculation of a remaining time on the basis of new control signals and measured values.

16. The method according to claim 12, which comprises outputting an empirical value being a function of at least one of an entered type and an amount of laundry and of a target dryness level for an entire program sequence duration, at a start of a program sequence.

17. The method according to claim 16, which comprises comparing the empirical value with subsequently ascertained program sequence periods of time in programs proceeding with identical program parameters on the basis of calculations of the fuzzy processor, correcting the empirical value, and exchanging the corrected empirical value with a former empirical value in the memory.

18. The method according to claim 17, which comprises averaging the empirical value and a predetermined number of subsequently ascertained program sequence time periods, for correction of the empirical value.

* * * * *